US008231409B2

(12) United States Patent
Lebrun et al.

(10) Patent No.: US 8,231,409 B2
(45) Date of Patent: Jul. 31, 2012

(54) CONNECTOR HAVING A FRONT GRID ACTUATED BY A COUNTERPART CONNECTOR

(75) Inventors: Jean-Marc Lebrun, Leves (FR); Philippe Daudin, Pierres (FR)

(73) Assignee: FCI Automotive Holding, Guyancourt (FR)

( * ) Notice: Subject to any disclaimer, the term of this patent is extended or adjusted under 35 U.S.C. 154(b) by 150 days.

(21) Appl. No.: 12/449,755

(22) PCT Filed: Feb. 26, 2007 (Under 37 CFR 1.47)

(86) PCT No.: PCT/IB2007/051458

§ 371 (c)(1), (2), (4) Date: Feb. 22, 2010

(87) PCT Pub. No.: WO2008/104838

PCT Pub. Date: Sep. 4, 2008

(65) Prior Publication Data

US 2010/0285696 A1 Nov. 11, 2010

(51) Int. Cl.
*H01R 13/40* (2006.01)

(52) U.S. Cl. ..... 439/595

(58) Field of Classification Search ..... 439/265, 439/268, 660, 744, 751, 752, 752.5, 595
See application file for complete search history.

(56) References Cited

U.S. PATENT DOCUMENTS

| | | | | |
|---|---|---|---|---|
| 4,629,271 | A * | 12/1986 | Awano | 439/260 |
| 5,645,453 | A * | 7/1997 | Yamaguchi | 439/595 |
| 2004/0067686 | A1 * | 4/2004 | Nimura | 439/595 |
| 2007/0049088 | A1 * | 3/2007 | Mohs et al. | 439/265 |

FOREIGN PATENT DOCUMENTS

| | | | |
|---|---|---|---|
| DE | 195 38 613 | A1 | 5/1996 |
| DE | 103 32 313 | A1 | 2/2004 |
| EP | 0 967 686 | A1 | 12/1999 |
| EP | 1 257 007 | A2 | 11/2002 |
| EP | 1 760 837 | A1 | 3/2007 |

* cited by examiner

*Primary Examiner* — Chandrika Prasad
(74) *Attorney, Agent, or Firm* — Harrington & Smith

(57) ABSTRACT

The invention relates to an electrical connector comprising including a housing for electrical contacts having a plugging face, and a front grid to be mounted onto the plugging face of the housing according to a plugging axis, the housing comprising including a series of locking members that lock the contacts in place, the front grid comprising: including mounting arrangements arranged for allowing the mounting of the front grid onto the housing from an open position into a closed position only if the contacts are locked in place in the housing, and at least one retractable stop member arranged for stopping the plugging of the counterpart connector with the connector as long as the front grid is not in the closed position, wherein the or each retractable stop member is arranged such that its retraction in the closed position of the front grid can be caused by a sole force exerted thereon in a direction substantially parallel to the plugging axis.

11 Claims, 5 Drawing Sheets

CONNECTOR HAVING A FRONT GRID ACTUATED BY A COUNTERPART CONNECTOR

FIELD AND BACKGROUND OF THE INVENTION

The invention relates to electrical connectors.

More particularly, it relates to connectors used for automotive applications for example in Lighting such as connectors for motor vehicles headlights. Such headlights comprise typically a base plugged to a connector fixed into the vehicle and fed in current by the electrical network of the vehicle.

It is important for the driving security that each headlight is correctly fed, i.e. that the connector is correctly connected to the network, in particular that the electrical contacts, provided at the end of the network, are correctly locked into the connector.

In order to insure this security, WO 2006/034864 discloses a connector comprising a housing for the electrical contacts and a Terminal Position Assurance (TPA) front grid to be mounted onto the plugging face of the housing. The TPA front grid insures that the counterpart connector (i.e. the base in our application) can not be plugged if the contacts are not locked in the housing, and therefore the plugging is rendered impossible if the connector is not correctly fed.

To this aim, the TPA front grid of this document comprises lock mechanism that locks the TPA front grid onto the housing in a locking position of the contacts, and flexible opposite tabs for stopping the plugging with the counterpart connector. It is possible to retract these opposite tabs from the path of the counterpart connector by hand-pressing them to each other, only if the front grid is mounted onto the housing at the locking position. Otherwise, the tabs are not retractable, and the counterpart connector abuts onto the tabs, the plugging operation being therefore rendered impossible.

One aim of the invention is to provide a connector with an improved ease of manipulation, during the assembly and/or disassembly with the cable.

To this aim, the invention proposes, according to a first aspect a connector according to claim 1.

DETAILED DESCRIPTION OF THE INVENTION

Figure 1:
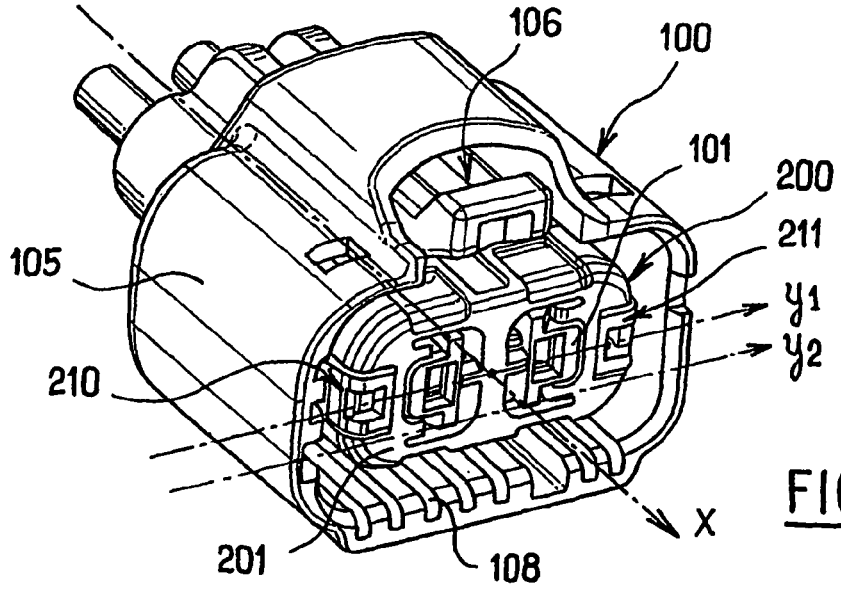
FIG. 1 is a perspective view of a connector according to the invention.

FIG. 1 shows an electrical connector according to the invention.

The electrical connector is arranged for being plugged to a counterpart connector 500 (as shown for example in FIG. 9) according to a plugging axis, referred as X-axis on figures.

The connector comprises:

a housing 100 for receiving electrical contacts;

a front grid 200 to be mounted onto the housing 100.

Figure 7:
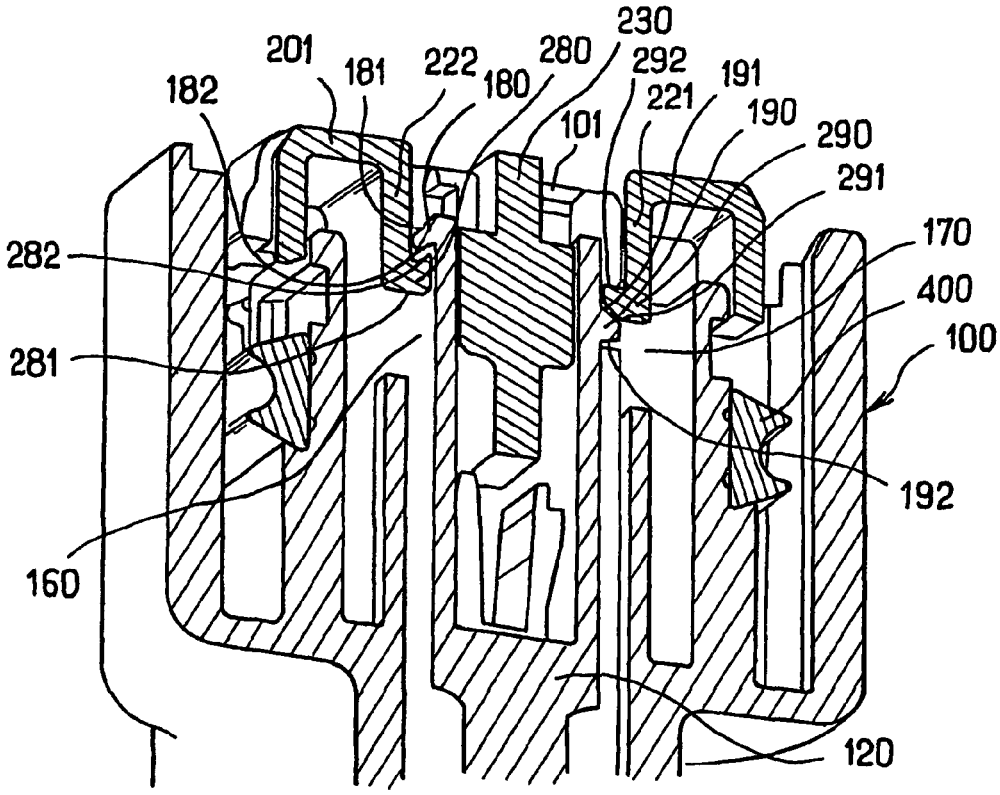
FIGS. 7 and 8 are cross-sections along a plane comprising Y2-axis and parallel to the X-axis (see FIG. 1), showing a part of a connector according to the invention at respective two plugging positions with a counterpart connector.

Optionally, a sealing element 400 (FIGS. 7 and 8) is provided between the housing 100 and a counterpart connector 500 to be plugged with, in order to prevent the connector from any moisture and dust. The sealing element 400 may be annular and mounted on a inner wall of the housing 100 so as to tightly contact an inner face of an outer shell 550 of the counterpart connector 500 used for guiding the said plugging in a corresponding gap 150 provided in the housing 100.

The housing 100 may be formed by molding in an electrically insulator material, preferably in a plastic material.

Figure 9:
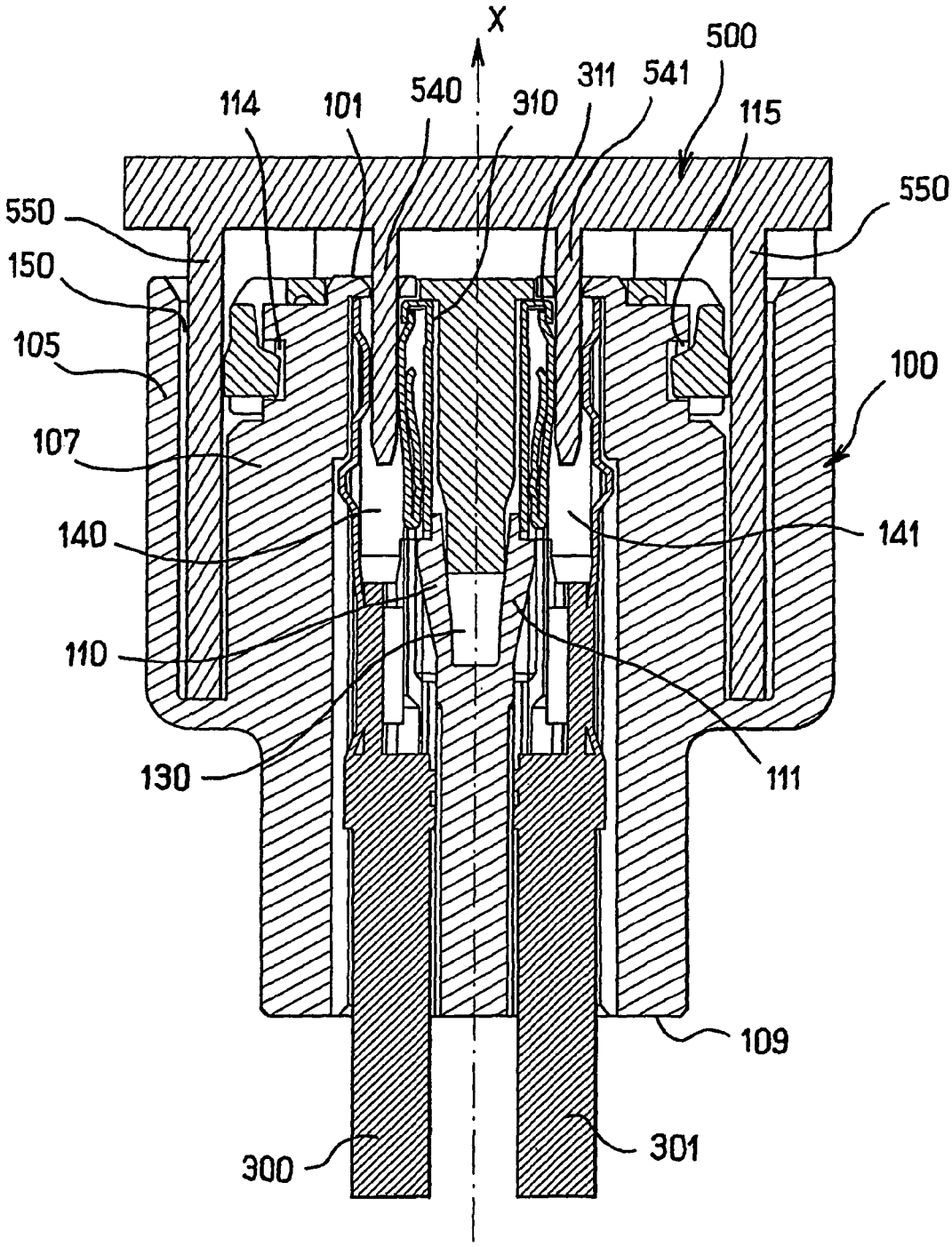
FIG. 9 are cross-sections along a plane comprising X- and Y1-axes (see FIG. 1), showing a connector according to the invention once plugged to a counterpart connector.

Referring to FIG. 9, the housing 100 may have a general parallelepipedic shape with an external shell 105 surrounding a central casing 107, and separated from the central casing 107 by the gap 150 able to receive a complementary shell 550 of the counterpart connector 500.

Referring to FIG. 1, the external shell 105 of the housing 100 may also be provided with means 106 for locking the plugging of the counterpart connector 500 with the connector, and/or with means for coding 108.

It is to be noticed that the counterpart connector 500 may be the base of a headlight of a motor vehicle.

Referring to FIG. 9, the housing 100 has further a plugging side 101, a back side 109, a plurality of contact channels 140-141 and one or more channels 130 that may extend in the central casing 107 parallel to the X-axis.

Contact channels 140-141 are designed for receiving electrical contacts 310-311, the latter being typically introduced in the housing 100 from its back side 109.

Electrical contacts 310-311 are typically made of an electrically conductive material and define ending parts of an external electrical network: they may be crimped with electrical wires 300-301 of a motor vehicle. Contacts 310-311 can be of female or male type.

Two adjacent contact channels 140-141 are at least partly separated by an inner wall 120 that extends or not until the front side 101.

The inner wall 120 has a portion divided in two resilient locking pawls 110-111.

The said channel 130 extends from the plugging side 101 generally parallel to the X-axis, and is laterally limited by one or two of adjacent pawls 110-111.

Figure 6:
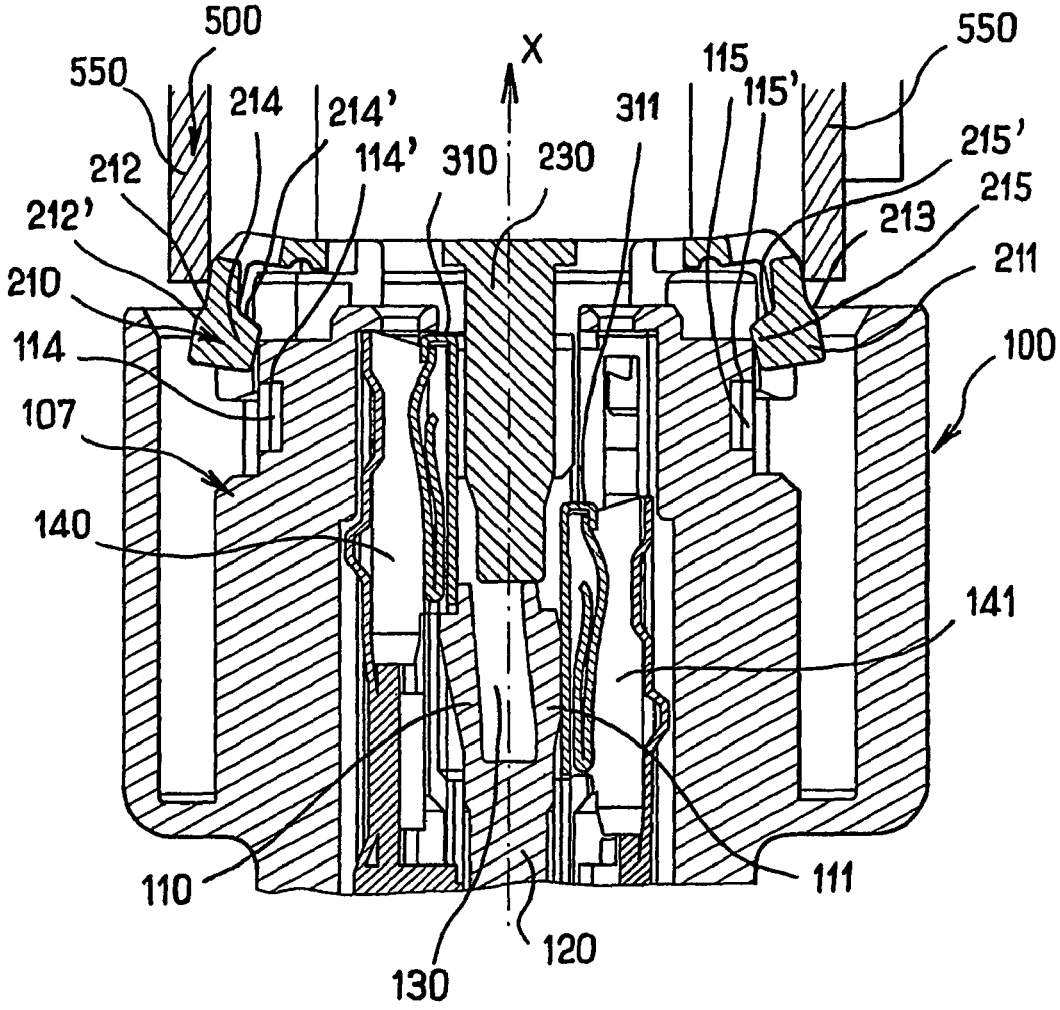

Each locking pawl 110-111 is arranged for:

locking a contact 310-311 when the latter is sufficiently introduced in the contact channel 140-141 until a "locking position" (see FIG. 5); it is to say that the contact 310-311 is then in place;

being stressed outwardly from contact channel 140-141 by the contact 310-311 when the latter is not sufficiently introduced in the contact channel 140-141 toward the "locking position" (see FIG. 6). The locking pawl 110-111 is therefore laterally deformed inwardly the channel 130.

The plugging side 101 of the housing 100 is typically a panel provided with openings 102-104 communicating with the contact channels 140-141 and opening(s) 103 communicating with the channel(s) 130.

Figure 10:
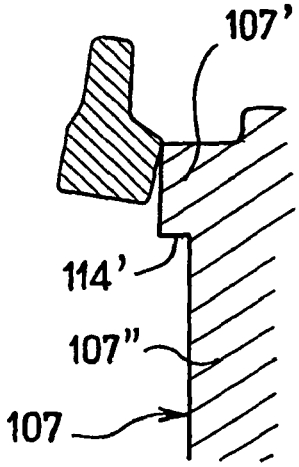
FIG. 10 is a cross-section along a plane comprising X- and Y1-axes (see FIG. 1), showing a part of an alternative connector according to the invention during the mounting of a front grid onto a housing of the connector.

The central casing 107 has outer lateral sides extending from the plugging side 101 towards generally the X-axis, some of them or all of them having each one step 114'-115' extending generally towards the X-axis. Each step 114'-115' may define an edge of a recess 114-115 provided in the corresponding outer lateral side. Alternatively, step 114'-115' delimits a front part 107' and a rear part 107" of the corresponding outer lateral side (see FIG. 10).

Advantageously, the sealing element 400 is hold around the outer lateral sides of casing 107 at a position along X axis below the steps 114'-115', optionally recesses 114-115, from the plugging side 101.

Figure 2:
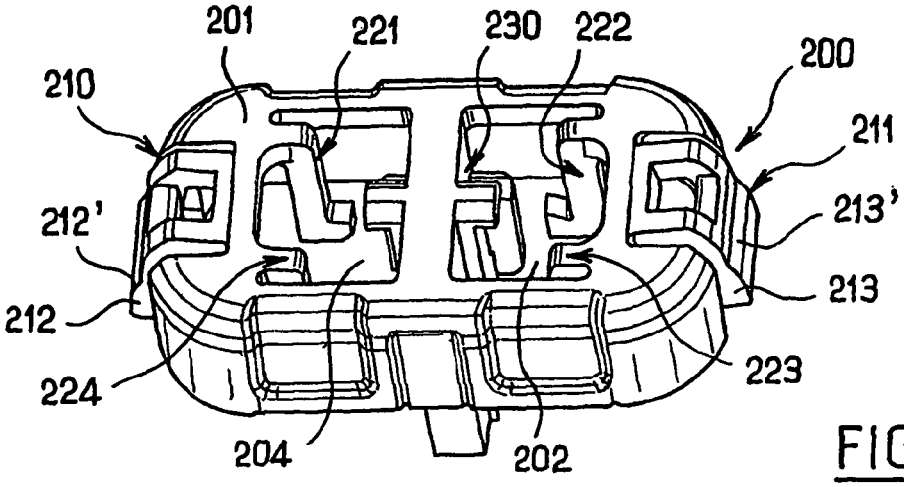
FIGS. 2 and 3 show respective front and rear perspective views of a front grid of a connector according to the invention.
Figure 3:
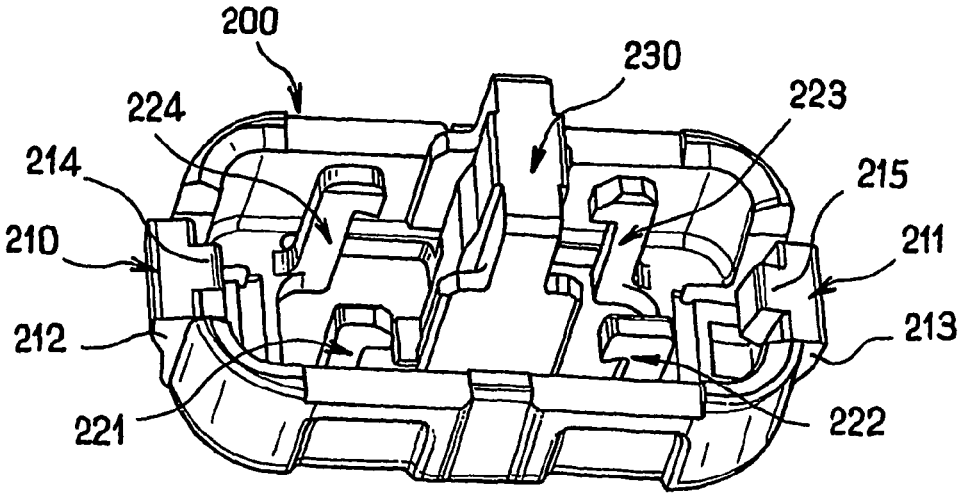

Referring to FIGS. 2, 3 and 9, the front grid 200 may be formed in a single piece by molding, preferably in an electrically insulator material, such as a plastic material.

The front grid 200 may comprise a front panel 201 having a plurality of transversal connecting windows 202-204 facing the openings 102-104 of the plugging side 101 of the housing 100, such that the counterpart terminal elements 540-541 of the counterpart electrical connector 500 can be introduced into the contact channels 140-141 via the connecting windows 202-204 and the openings 102-104.

The front grid 200 is further provided with at least one mating arm 230 extending from the font panel 201 in a direction chosen for penetrating into the at least one channel 130 via the opening 103, until a "closed position".

Figure 4:
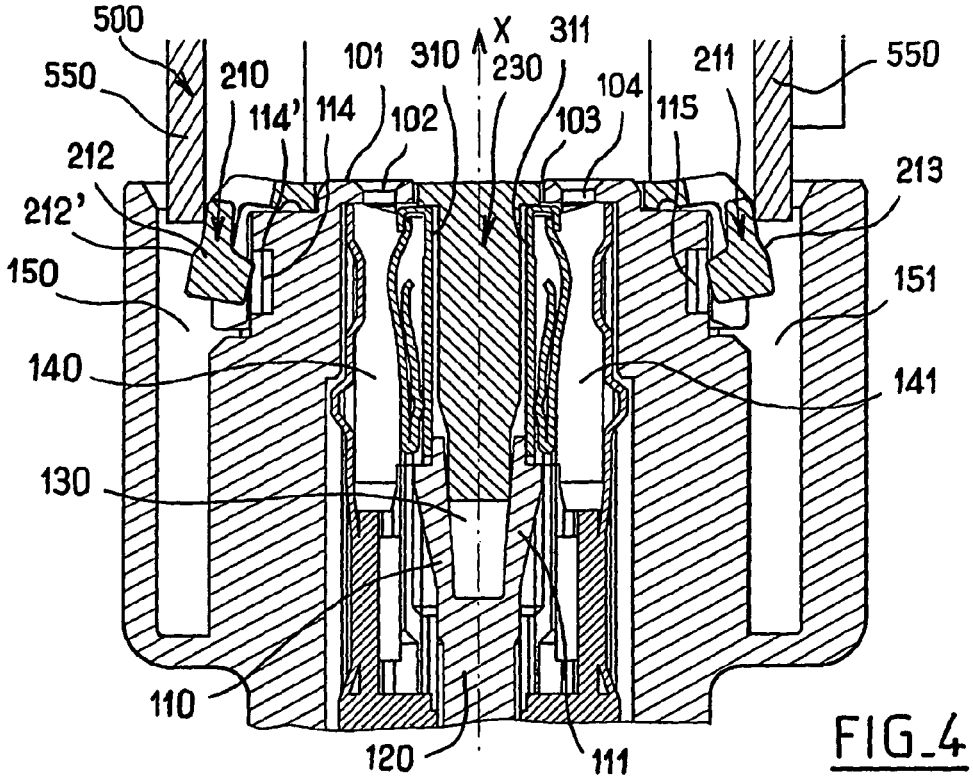
FIGS. 4, 5 and 6 are cross-sections along a plane comprising X- and Y1-axes (see FIG. 1), showing a part of a connector according to the invention during the plugging with a counterpart connector.
Figure 5:
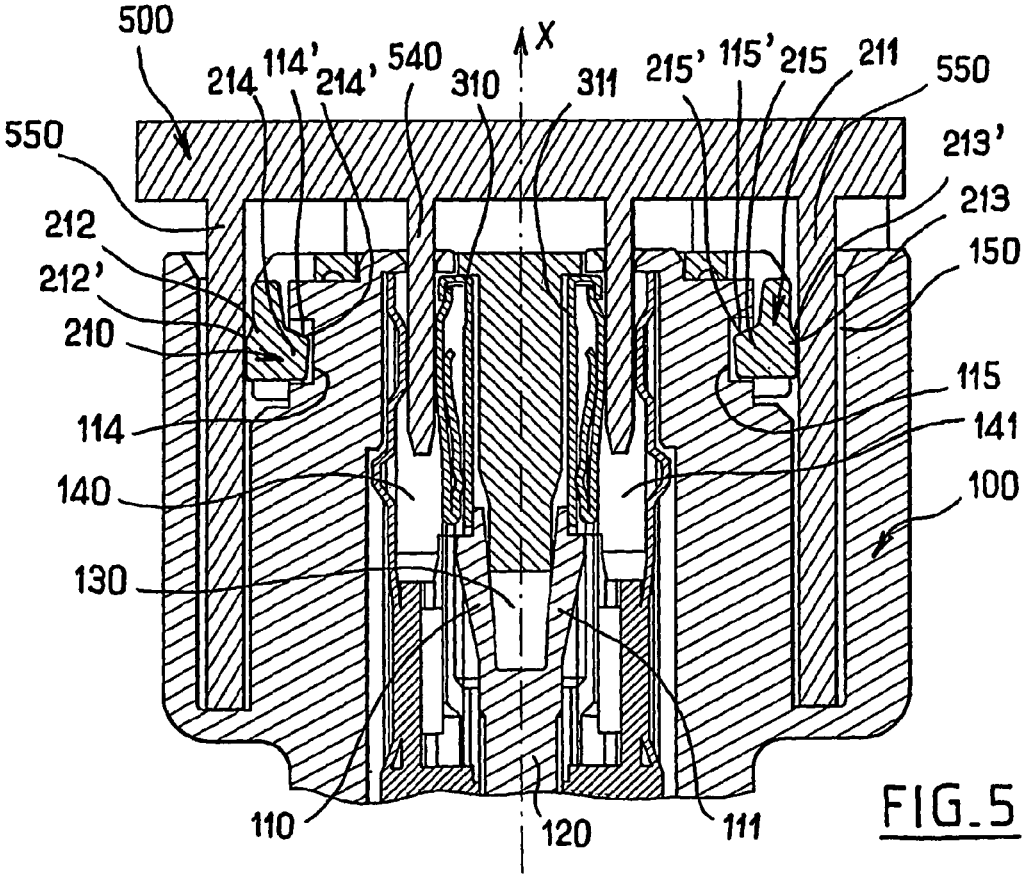

Referring to FIGS. 4, 5 and 9, this "closed position" is found by the mating arm 230 only if none of the locking pawls 110-111 stressed by a contact 310-311 obstructs the channel 130 and therefore stops the penetration of the mating arm 230 into the guiding channel 130.

On the contrary, and referring to FIG. 6, if a terminal contact 310-311 has not reached its final working position, a locking pawl 111 is stressed by this terminal contact 311, and therefore obstructs the channel 130: the mating arm 230 abuts onto the pawl 111, and the front grid 200 can not be mounted to the closed position.

According to the invention, the front grid 200 is further provided with at least one retractable stop member 210-211 arranged for stopping the plugging of the connector with the counterpart connector 500 as long as the front grid 200 is not mounted onto the housing 100 at the "closed position".

Each retractable stop member 210-211 is preferably arranged for being, once the front grid 200 is mounted at least partially onto the housing 100, adjacent to lateral sides of the central casing 107 of the housing 100.

At least one retractable stop member 210-211 may be a flexible tab extending rearwardly from edge(s) of the front panel 201 of the front grid 200 and outwards the X-axis.

Additionally or alternatively, at least one retractable stop member 210-211 may be a flexible tab 210-211 extending rearwardly from edge(s) of the front panel 201 of the front grid 200, each tab 210-211 having a protruding element 212-213 on its outer face for abutting the counterpart connector 500 during the plugging operation.

Each retractable stop member 210-211 may be elastically rotated, when it is pushed towards the X-axis, around an axis located proximate the front panel 201 and substantially perpendicular to the X-axis.

Each retractable stop member 210-211 is therefore arranged so as to be retractable, when the grid 200 is at the "closed position", if a plugging force is exerted on it, substantially parallel to the X-axis, by the counterpart connector 500 during the plugging operation. See FIGS. 4 and 5 for illustration.

During the plugging, the retraction of the retractable stop members 210-211 is carried out by the counterpart connector 500 in pressing them onto outer lateral sides of the central casing 107 of the housing 100.

Each tab 210-211 includes a projection 214-215 on its inner face to be pushed, when grid is at the "closed position", behind the step 114'-115', into the optional recess 114-115, provided on sides of the housing 100, thus allowing operating a retraction of the tabs 210-211. Then, as seen on FIGS. 4 and 5, the tabs 210-211 are retracted from the path of the shell 550 of the counterpart connector 500 if the front grid 200 is mounted at the said "closed position".

This retraction may be facilitated if an outer surface of each protruding element 212-213 has a ramp 212'-213' on which the shell 550 can contact during plugging. The motion of the counterpart connector 500 according to X-axis is thus transformed in a motion directed to the recess 114-115.

Alternatively or additionally, the end of the shell 550 is provided with a corresponding chamfrain that leads to the same result (not shown).

However, as shown in FIG. 6, the stop members 210-211 abuts onto the outer lateral sides of the central casing 107 and can not be pushed beyond the steps 114'115', if the front grid 200 is not mounted at the said "closed position". The stop members 210-211 are therefore not retracted and offer a stop to the path of the counterpart connector 500, the latter can thus not be plugged to the connector.

The plugging can therefore only be operated if the contacts 310-311 are locked and if the front grid 200 is at the "closed position".

This connector insures thus the impossibility of mounting the counterpart connector 500 onto the connector if the latter does not lock the contacts 310-311.

Additionally, this connector allows a second locking of the front grid 200 on the housing 100 once the counterpart connector 500 is plugged, concurrently to the locking through the retaining members 221-224 described hereafter, the latter taking place independently of the counterpart connector. This second locking ensure that the grid 200 cannot move until the counterpart connector is disconnected. Members 230 and 221-224 form mounting arrangements.

Moreover, this configuration of the stop members 210-211 allows the closing of the front grid 200 onto the housing 100 by simply pushing the front grid 200 towards the housing 100 according to the X-axis.

Thus, the motion of the counterpart connector 550 during plugging is sufficient by itself for retracting the stop members 210-211. There is therefore no need for an operator to act on the stop members 210-211 by hand-pressing.

This allows providing connectors of small dimensions, wherein the stop members 210-211 are so small that they are difficult to manipulate.

This is also useful if we consider that the shell 105 prevents the operator from reaching the stop members 210-211 once the front grid 200 is mounted onto the housing 100 at a closed position. The connector of the invention allows an operator to put the front grid 200 into the closed position even if the stop members 210-211 are inaccessible. This is particularly useful for connectors having small dimensions, in which such a reinforcing shell 105 may be necessary. The invention allows thus the connectors manufacturers providing new designs for their connectors.

The connector may also be designed for allowing an easy disassembling of the front grid 200 from the housing 100, implemented by pulling away the front grid 200 from the housing 100, from the closed position to the opened position.

Particularly, referring to FIG. 4, each projection 214-215 of the stop members 210-211 may be provided with a ramp 214'-215' facing the steps 114'-115', allowing then the ramps 214'-215' slid onto the steps 114'-115' during dismounting. The force of dismounting is therefore substantially diminished, and the front grid 200 is preserved from damages.

Alternatively or additionally, the said ramp may be provided on each step 114'-115' (not shown).

Referring to FIGS. 2, 3, 7 and 8, the front grid 200 may be further provided with retaining members 221-222-223-224 arranged for being stopped by inner retaining elements 180-190 provided in the housing 100 when the front grid 200 is pulled away from the housing 100, preventing thus the two latter elements from being separated.

These retaining members 221-222-223-224 may comprise, flexible legs 221-222 extending from the front panel 201 towards the housing 100 and ended by teeth 290-280.

The corresponding retaining elements 190-180 may be provided in the walls 120 for abutting the teeth 290-280 when the front grid 200 is mounted onto or dismounted from the housing 100. These retaining elements 190-180 may be teeth extending transversally to the general extension of the wall 120 into adjacent chambers 170-160 of the housing 100, these adjacent chambers being aimed at receiving the retaining members 221-222-223-224.

Moreover, the teeth 290-280 can go beyond the corresponding teeth 190-180 by flexion of the legs 221-222-223-224 during abutment, if the front grid 200 is pushed towards and/or pulled away from the housing 100 with a sufficient force.

The positions of some teeth 180 in the longitudinal axis of the housing 100 can be different from the positions of other teeth 190. Some teeth 180 may be closer from the plugging side 101 than other teeth 190. If there is for example four teeth 180-190, it could be advantageous providing two teeth 180 closer to the plugging side 101 than the two other teeth 190, and that the projection of the four teeth 180-190 onto the plugging side 101 of the housing 100 are the corners of a rectangular whose one diagonal includes the projection of the two teeth 180.

The teeth 180 closer to the plugging side 101 may be arranged for stopping the teeth 280 when a separation force exerted by pulling away the front grid 200 from the housing 100 is lower than a limit separation force. This limit separation force may be chosen about 50 Newtons. The closer teeth may be particularly adapted for preventing the separation of the front grid 200 from the housing 100.

Figure 8:
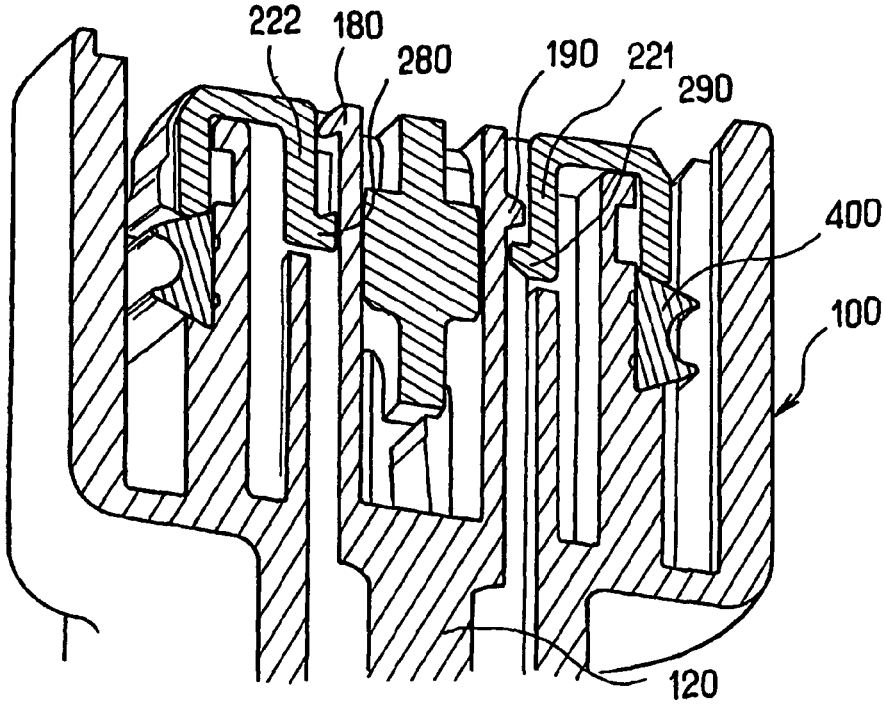

The farer teeth 190 may define:

an "opened position" (shown on FIG. 7) and a "closed position" (shown on FIG. 8)

of the front grid 200 with respect to the housing 100 which depends on the tooth 290 being, respectively below; or beyond the tooth 190.

Moreover it may be possible for:

the tooth 290 to force the path at the teeth 190 from the opened position to the closed position when a closing force exerted by pushing the front grid 200 towards the housing 100 is greater than a limit closed force;

the tooth 290 to force the path at the teeth 190 from the closed position to the opened position when an opening force exerted by pulling the front grid 200 away from the housing 100 is greater than a limit opening force; it is to be noticed that the opened position is a position of the teeth 280-290 limited by the teeth 180 and 190.

It is to be noticed that the said closed and opened limit forces may also depend on the opposing forces exerted by the outer lateral sides 107 onto the deflectable stop members 210-220 during the closing and opening motions. It is to be noticed that these limit forces may be greatly diminished by the presence of said optional ramps on the protruding elements 212-213, projections 214-215 and/or steps 114'-115' and by the spring characteristic of the stop members 210-211.

The limit closed force may thus be chosen between around 20 and around 40 Newtons The limit opening force may thus be chosen between around 10 and around 30 Newtons.

An equivalent arrangement may be provided for the positions and dispositions of the teeth 280-290 of the legs 221-222-223-224, and especially for "closer" and "farer" teeth from the front panel 201.

Advantageously, the tooth 280-290 of at least one flexible leg 222-221 has a front ramp 281-291 and a rear ramp 282-292 and the corresponding tooth 180-190 has a corresponding front ramp 181-191 and rear ramp 182-192, such a way that the limit closing and opening forces can be adjusted by choosing the angles of those ramps, in combination with the choice of spring characteristic of the flexible legs. Especially the force necessary for going beyond the tooth 180-190 can be chosen different in the mounting direction than in the dismounting direction.

For example, for the teeth 180 closer to the plugging face 101, these ramps may be arranged for rendering easier the legs 222-224 going beyond during the mounting than during the separation. In particular the angles of the rear ramps 182-282 may be chosen such that the tooth 280 is strongly retained by the tooth 180, until for example the said separation force.

For example, for the teeth 190 farer from the plugging face 101, the ramps can be arranged for rendering easier the legs 222-224 passing from the closed position into the opened position than from the opened position into the closed position.

These "opened position" and "closed position" may be useful for the operations of the connector. The connector may be delivered by a supplier, or prepared for the cable assembly, by setting it at the opened position. At this position, the connector is in a single part (the front grid 200 is retained on the housing 100 by the teeth 180) while leaving the front grid 200 free from its closed position. Once the contacts 310-311 are set into the connector, the operator will then close the front grid 200 onto the housing 100. The counterpart connector 500 (e.g. the base of a headlight) can then be mounted onto the connector only if the front grid 200 was successively brought at the "closed position", i.e. only if the connector efficiently locks the contacts 310-311 (e.g. provided at the end of an electrical network embedded in a motor vehicle).

The invention claimed is:

1. An electrical connector assembly comprising an electrical connector and a counterpart connector, where the electrical connector comprises a housing for electrical contacts having a plugging face, and a front grid to be mounted onto the plugging face of the housing according to a plugging axis, the housing comprising a series of locking members that lock the contacts in place, the front grid comprising:

mounting arrangements arranged for allowing the mounting of the front grid onto the housing from an opened position into a closed position only if the contacts are locked in place in the housing, and at least one retractable stop member arranged for stopping the plugging of the counterpart connector with the electrical connector as long as the front grid is not in the closed position, wherein the or each retractable stop member is configured such that retraction in the closed position of the front grid can be caused by a force exerted on the front grid via the counterpart connector in a direction substantially parallel to the plugging axis.

2. The electrical connector assembly according to the previous claim 1, wherein at least one retractable stop member comprises at least one flexible tab extending from an edge of a front side of the front grid rearwardly and outwardly from the plugging axis.

3. The electrical connector assembly according to claim 1, wherein at least one retractable stop member includes a protruding element for stopping the counterpart connector during plugging if the front grid is not at the closed position and for being retracted with the retractable stop member if the front grid is at the closed position.

4. The electrical connector assembly according to claim 1, wherein at least one stop member comprises a projection towards the housing and wherein the housing is provided with at least one step beyond which the corresponding projection can retract when the front grid is at the closed position.

5. The electrical connector assembly according to claim 1, arranged for allowing an easy disassembling of the front grid from the housing.

6. The electrical connector assembly according to claim 1, wherein the mounting arrangements comprise flexible retaining members arranged for being stopped by inner retaining elements provided in the housing when a separation force exerted by pulling the front grid away from the housing is lower than a limit separation force.

7. The electrical connector assembly according to claim 1, wherein the mounting arrangements comprise flexible retaining members and inner retaining elements arranged such that the front grid can be retained on the housing either in an opened position where at least one retaining member and a corresponding retaining element are in a open position retaining relationship with each other or in a closed position when this at least one retaining member and the corresponding retaining element are in a closed position retaining relationship with each other.

8. The electrical connector assembly according to claim 7, wherein the forces required for the front grid to reach the closed position retaining relationship and for the front grid to be released from the closed position retaining relationship are different from each other.

9. The electrical connector assembly according to claim 1, wherein the mounting arrangements comprise at least one mating arm extending rearwardly from the plugging face of the front grid and adapted for penetrating into at least one guiding channel provided in the housing and capable of being obstructed by at least one locking member when a contact is not properly locking in place, whereby in such case the closed position of the front grid cannot be reached.

10. The electrical connector assembly according to claim 1, wherein the counterpart connector is configured to provide a second locking of the front grid on the housing once the counterpart connector is plugged with the electrical connector.

11. Electrical connector to be plugged to a counterpart electrical connector according to a plugging axis, comprising:

a housing comprising:

a casing with outer lateral sides having each one lateral recess;

contact channels for receiving electrical contacts within;

at least one guiding channel separated from at least one contact channel by at least one resilient locking pawl;

a plugging face through which openings communicate with the contact and the at least one guiding channel;

inner retaining elements;

a front grid for being mounted onto the said plugging face according to a plugging axis, the front grid comprising:

a front side for facing the plugging face;

at least one mating arm extending rearwardly from the front side for penetrating into the at least one guiding channel;

retaining members extending rearwardly from the front side and arranged for being stopped by the inner retaining elements when the front grid is pulled away from the housing;

flexible lateral tabs extending rearwardly from opposite edges of the front side generally parallel to the plugging axis, each tab having a projection able to be housed in one of said lateral fixing recesses;

wherein at least one locking pawl is arranged for being:

in a "locking position" when an electrical contact is locked onto the pawl such that the pawl does not obstruct the penetration of the mating arm into a guiding channel adjacent to the pawl;

in a "stressed position" when an electrical contact is not in a correct position so as to laterally stress the pawl inwardly the guiding channel adjacent to the pawl such that the mating arm abuts onto the pawl, therefore the front grid being not able to be mounted at the closed position;

wherein the lateral tabs are arranged for being pressed towards the lateral sides of the housing by the counterpart electrical connector during plugging such that:

in a "closed position", the projections of the flexible tabs can be housed by corresponding lateral fixing recesses such that the tabs are retracted from the sliding path of the counterpart electrical connector along the lateral sides of the housing, a complete plugging operation can therefore be achieved;

in an "opened position", the projections of the flexible tabs cannot be housed by corresponding lateral fixing cavities such that the tabs are not retracted, and obstruct the sliding path of the counterpart electrical connector, the complete plugging operation can therefore not be achieved;

and wherein:

the retaining members are stopped by a number of inner retaining elements at the "closed position" if the front grid is pulled away from the housing for reaching an "opened position";

the retaining members are stopped by the number of inner retaining elements at the "opened position" if the front grid is pushed towards the housing for reaching the "closed position".

* * * * *